US010143276B1

(12) United States Patent
Wellen et al.

(10) Patent No.: US 10,143,276 B1
(45) Date of Patent: Dec. 4, 2018

(54) DUAL HANDLE UMBRELLA FOR USE BY AN ADULT AND CHILD

(71) Applicants: Nathaniel C. Wellen, Atlanta, GA (US); Alexander B. Wellen, Atlanta, GA (US)

(72) Inventors: Nathaniel C. Wellen, Atlanta, GA (US); Alexander B. Wellen, Atlanta, GA (US)

( * ) Notice: Subject to any disclaimer, the term of this patent is extended or adjusted under 35 U.S.C. 154(b) by 0 days.

(21) Appl. No.: 15/408,149

(22) Filed: Jan. 17, 2017

Related U.S. Application Data

(60) Provisional application No. 62/280,514, filed on Jan. 19, 2016.

(51) Int. Cl.
*A45B 25/00* (2006.01)
*A45B 19/04* (2006.01)

(52) U.S. Cl.
CPC ..... *A45B 25/00* (2013.01); *A45B 19/04* (2013.01); *A45B 2025/003* (2013.01); *A45B 2200/1081* (2013.01)

(58) Field of Classification Search
CPC ..... A45B 25/00; A45B 2025/003; A45B 2200/1009; A45B 2200/1081; A45B 2200/109
See application file for complete search history.

(56) References Cited

U.S. PATENT DOCUMENTS 1,520,070 A * 12/1924 Nelson ..... A45B 9/00 135/15.1
3,148,851 A * 9/1964 Condon ..... A45B 11/00 135/16

(Continued)

FOREIGN PATENT DOCUMENTS

FR 3017517 A1 * 8/2015 ..... A45B 9/02
WO WO-2016050999 A1 * 4/2016 ..... A45B 19/04

OTHER PUBLICATIONS

Web Article: "Amagoing Car Inverted Umbrella Double Layer Windproof Reverse Umbrella for Rain Sun", 7 pages, Jan. 18, 2017, https://www.amazon.com/Amagoing-Inverted-Umbrella-Windproof-Reverse/dp/B01MQEMCKF/ref=sr_1_2?ie=UTF88iqid=1484762802&sr=8-2&keywords=umbrella+for+two+adults.

(Continued)

*Primary Examiner* — David R Dunn
*Assistant Examiner* — Danielle Jackson
(74) *Attorney, Agent, or Firm* — Winston & Strawn LLP

(57) ABSTRACT

In accordance with the embodiments of the present invention, a dual handle umbrella is disclosed, wherein the umbrella comprises a pole that is operatively associated with a first upper user grasping handle for holding the umbrella upright, and wherein the umbrella further comprises a second lower handle spaced by a distance away from and below the first upper user grasping handle provided by an extension member. The extension member is adjustable to place the second lower handle at different distances away from the first upper user grasping handle, such that a person, who is shorter than the user can hold onto the umbrella by grasping the second lower handle. As such, a user can hold the first upper grasping handle, while a shorter person, e.g. a child, can simultaneously hold the second lower handle. Other advantages that are further understood from the disclosure will be apparent to the reader.

13 Claims, 4 Drawing Sheets

(56) References Cited

U.S. PATENT DOCUMENTS 3,304,036 A * 2/1967 Davis ..... A45B 11/00 248/229.14
5,411,237 A * 5/1995 Dougherty ..... A45B 11/00 224/274
5,687,946 A * 11/1997 Cho ..... A45B 11/00 248/156
5,836,327 A * 11/1998 Davis ..... A45B 11/00 135/16
6,085,766 A * 7/2000 Geary ..... A01B 1/00 135/68
6,435,469 B1 * 8/2002 Ratcliff ..... A45F 5/00 248/213.2
6,533,237 B1 * 3/2003 Matusek ..... A45B 11/00 248/291.1
7,726,326 B2 * 6/2010 O'Donnell ..... A45B 1/00 135/16
8,726,921 B2 * 5/2014 Wilkins ..... A45B 3/02 135/20.1
2012/0048316 A1 * 3/2012 Fournillier ..... A45B 11/00 135/16
2012/0168598 A1 * 7/2012 Walker ..... B60R 7/12 248/539

OTHER PUBLICATIONS

Web Article: "Double-Umbrella", 1 page, Oct. 18, 2017 http://www.promo-wholesale.com/Upfiles/Prod_p/Double-Umbrella_200907174118.jpg.

Web Article: "Two Handle Umbrella", 2 pages, Jan. 18, 2017 http://www.bing.com/images/search?q=two+handle++umbrella&view=detailv2&&id=E2B5369245A185EE734463F1F0C34F371E857595&selectedIndex=92&ccid=FayftvUR&simid=608006837425604479&thid=OIP.M15ac9fb6f5113528847b2725b4a4e6e8o0&ajaxhist=0.

* cited by examiner

DUAL HANDLE UMBRELLA FOR USE BY AN ADULT AND CHILD

This application claims the benefit of provisional application 62/280,514 file Jan. 19, 2016, the entire content of which is expressly incorporated herein by reference thereto.

FIELD OF INVENTION

The invention generally relates to umbrellas, and more particularly, to umbrellas having at least two grasping handles that are spaced apart via an extension member, such that an adult can hold the upper situated first handle, while a child who is shorter than the adult, can hold the lower lying second handle.

BACKGROUND OF THE INVENTION

It is a well-accepted fact that umbrellas provide a functionality as an everyday necessity. As would be known, the structure of umbrellas effectively provides shade and protection to the user from extreme and inclement weather conditions, such as e.g. when it rains heavily, when it is extremely hot and there is a severe amount of ultraviolet radiation reaching the surface of the earth, or just simply when it snows or there is hail together with an intensely windy condition outside. These apparatuses come in many different shapes and forms ranging from large patio and beach umbrellas to more compact, and usually collapsible personal umbrellas. These extreme weather conditions may not be well-tolerated physically nor psychologically, and can therefore exhibit inconveniences that are especially felt by parents when they have to walk their children to school or any other place. This especially holds true, because not only are the parents faced with ensuring the safety of the children by holding their hands when for example crossing streets etc., but unfavorable weather conditions can also result in potential unforeseen injury of the parents, as well as the children. While holding the hand of the child, the parent would similarly have to hold on to the umbrella, while trying to cover him or herself, as well as the child, so as to get full and efficient protection from a given harsh weather condition. Therefore, as can be realized, it is not an easy task to safely walk for the parent and the child sharing the same umbrella, as one would have to concentrate on a plurality of occurrences all happening at the same time in order to potentially avoid being subjected to any number of the hereinabove mentioned harmful stimuli.

Notwithstanding this, though there may exist prior art in this area that generally relates to umbrellas having two handles, however, the two handles are not retractable and extendable in relation to one another, having a first upper handle that can be held by the parent and a second lower handle that is held by the child. It follows that in light of this, to date, the prior art is still lacking a dual handle umbrella, wherein the handles are extendable, and are situated at different heights of the umbrella. Thus, they neglect to solve the prior mentioned considerations.

As such, in light of the challenges faced thus far, there still remains an unmet need for an umbrella that addresses the presented shortcomings. More essentially, there is a need for a flexible umbrella design having a physical dual handle configuration that can be operated by an adult and a child simultaneously under extreme and inclement weather conditions that can address and provide a solution to the above-mentioned problems faced thus far.

It is therefore an object of the present invention to overcome these and other issues and shortcomings associated with conventional umbrellas presented heretofore exhibiting two handles. In consequence of this, the present embodiments of the invention now provide such a novel solution to this problem, and others evident to those of ordinary skill in the art. As such, they satisfy the need of providing an easily operable umbrella having two grasping handles that are spaced apart and that are easily retractable and extendable. These and other objects will become apparent to one of ordinary skill in the art in light of the specification, claims, and drawings appended hereto.

SUMMARY OF THE INVENTION

In accordance with the principles of an embodiment of the present invention, a dual handle umbrella is contemplated that includes a pole, which is operatively associated with a first upper user grasping handle for holding the umbrella upright when the umbrella is open for use. The umbrella further comprises a second lower handle spaced by a distance away from and is situated below the first upper user grasping handle via an extension member. The extension member is adjustable to place the second lower handle at different distances away from the first upper user grasping handle, such that a person who is shorter than the user can hold onto the umbrella by grasping the second lower handle. The extension member typically contacts or is connected directly to the first upper user grasping handle. The extension member may be an extension of the umbrella pole and passes through the first upper user grasping handle. The extension member is collapsible so as to allow the second lower handle to be placed adjacent the first upper user grasping handle. Additionally, the pole and extension member may be configured and dimensioned such that, when the umbrella is not employed, the extension member is received within the pole or the second handle with the user and second handles adjacent each other for compact storage.

Alternatively, the extension member include a connection member opposite the second lower handle for attachment to the first upper user grasping handle. The connection member includes a clamping structure that has upper arms and a lower plate for receiving the user grasping handle therebetween. Moreover, in this embodiment, the extension member includes a contact member on the end opposite the lower second handle for contacting a bottom portion of the first upper user grasping handle. The contact member is movable towards or away from the user grasping handle by rotation of the connection member. The extension member and the lower plate are threadedly engaged to facilitate upward or downward movement of the contact member towards or away from the upper user grasping handle.

In yet another aspect of the invention, an umbrella is contemplated having a first upper user grasping handle, a pole, a canopy and a second lower handle spaced by a distance away from and below the first upper user grasping handle by an extension member. The extension member is adjustable to place the second lower handle at different distances away from the first upper user grasping handle, such that a person who is shorter than the user can hold onto the umbrella by grasping the second lower handle. The second lower handle and the extension member may be removably attached to the first upper user grasping handle. Additionally, the second lower handle and the extension member may be securely attached to the first upper user grasping handle or the pole.

In accordance with one embodiment, the dual handle umbrella may be advantageously attached to the lower pole portion of an existing umbrella. Alternatively, the dual handle umbrella may be composed of a unitary umbrella. These embodiments may include any of the various design alternatives disclosed herein.

Additionally, a band can be provided on the first or second handle to facilitate carrying of the umbrella when not deployed. This band may be adjustable. When the band is attached to the second handle, it may be wrapped around the shorter person's hand.

BRIEF DESCRIPTION OF THE FIGURES

The appended drawing figures provide additional details of the invention, wherein.

DETAILED DESCRIPTION OF THE INVENTION

The following definitions generally set forth the parameters of the embodiments of the present invention.

As used herein this disclosure, the term "pole" is the shaft that runs between the umbrella's handle at the bottom and the canopy at the top.

As used herein this disclosure, the term "canopy" refers to the fabric part of the umbrella that is functioned to catch rain, wind, sun, hail, snow and the like.

As used herein this disclosure, the term "telescopic extension member" refers to concentric tubular sections which are designed so as to slide easily into one another.

As used herein this disclosure, the term "opposite" refers to something having a position on the other or further side of something else, thus facing something, especially something of the same type.

As used herein this disclosure, the term "substantially" is meant to have the equivalent meaning of essentially, largely, considerably or the like.

As used herein this disclosure, the term "maximum" refers to the greatest quantity or value attainable or attained.

As used herein this disclosure, the term "minimum" refers to the least quantity assignable, admissible, attainable or possible.

As used herein this disclosure, the term "height" is the measurement of a vertical distance, whereas the term "length" is the measurement of a horizontal distance.

As used herein this disclosure, the term "collapsible" refers to the vertical adjustment of the height of the telescopic extension member.

As used herein this disclosure, the term "clamping structure" refers to a structure that has upper arms and a lower plate, such that the first upper user grasping handle of the umbrella can be received between the upper arms and the lower plate.

As used herein this disclosure, the term "connection member" includes a clamping structure.

As used herein this disclosure, the term "arcuate" refers to a structure that is substantially curvilinear.

Additionally, all dimensions recited herein are approximate and can vary by as much as ±10% to in some case ±25%. In some situations, the term "about" is used to indicate this tolerance. And when the term "about" is used before reciting a range, it is understood that the term is applicable to each recited value in the range. Often, the craftsmanship and engineering procedures that are followed in construction of these umbrellas minimize these tolerances as much as possible or industrially practical from the specifically recited values.

Figure 1A:
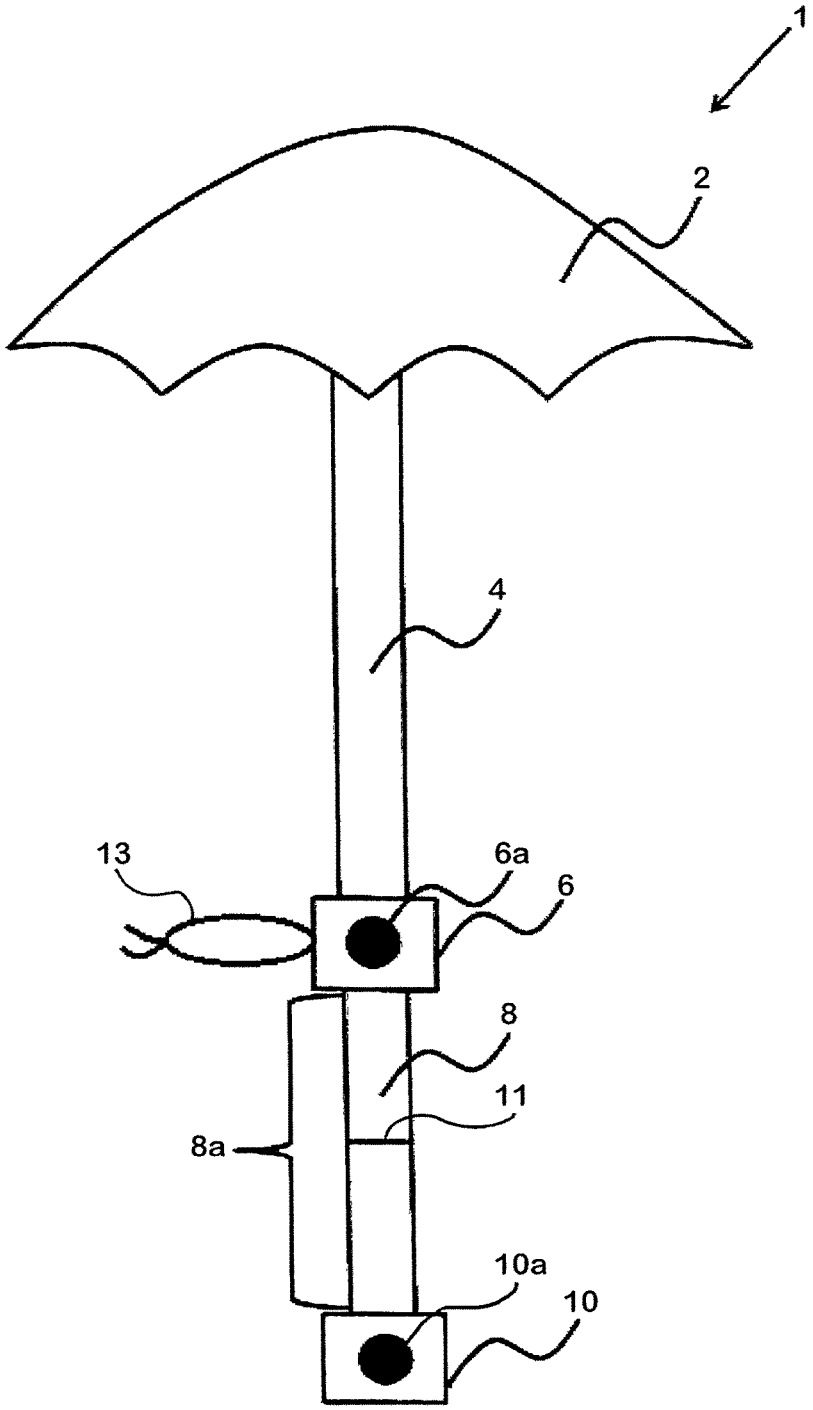
FIG. 1A depicts a side view of an extended conformation of the unitary dual handle umbrella in accordance with a first embodiment of the invention.
Figure 1B:
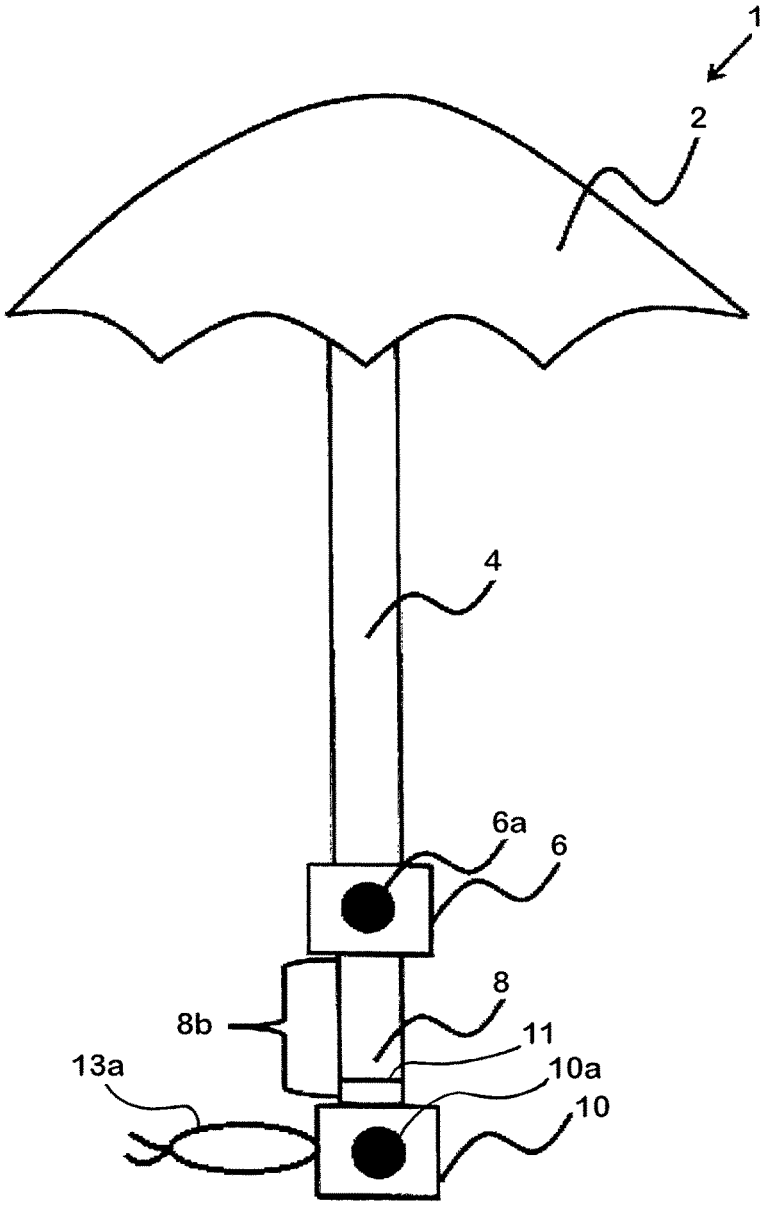
FIG. 1B shows a side view of a shortened conformation of the unitary dual handle umbrella in accordance with a second embodiment of the invention.

Now, generally referring to the drawings in which like numerals represent like components throughout the several views, the preferred embodiments of the present invention are next described. FIGS. 1A, 1B, 2 and 3 depict the various embodiments of the present invention. However, having said that, it should be clearly understood that these figures are merely provided as exemplary in nature, and they should in no way serve to limit the scope of the invention. In a first embodiment, the dual handle umbrella can take the form of a unitary design as depicted in FIGS. 1A and 1B, or in a different embodiment, the umbrella having the lower second handle with an extension member can be attached to an already existing umbrella as demonstrated in FIGS. 2 and 3.

Now generally giving reference to FIGS. 1A and 1B, the first embodiment of the dual handle umbrella will be outlined in greater detail referring to the presented numerals. Starting with FIG. 1A, as shown in FIG. 1A, the unitary dual handle umbrella (1), is composed of a canopy (2) attached to the upper part of an umbrella pole (4). Ideally, the canopy (2) is preferably made of a water resistant fabric in order to protect the user against the harmful elements directly caused by the weather. This may advantageously be microfiber fabrics like nylon that are then coated with special water repellant finishes. In any event, a skilled artisan would know that any material may be used to make the canopy (2), which does not subsequently compromise its ability to repel water.

The pole (4) is preferably made of a metallic material such as but not limited to e.g., steel or aluminum. However, one of ordinary skill in the art will appreciate that any such material that will not compromise the basic function of the umbrella (1) can be utilized in this regard like e.g., wood, fiberglass or other plastic types. The pole (4) is operatively associated and is connected directly with a first upper user grasping handle (6) for holding the umbrella (1) upright when the umbrella (1) is open for use. The first upper user grasping handle (6) further has built therein a button (6*a*) to operate the umbrella (1). When button (6*a*) is engaged, the canopy (2) is deployed. As such, in this embodiment, the first upper user grasping handle (6) is the handle held and therefore operated by the parent or adult. Therefrom, the first upper user grasping handle (6), a telescopic extension member (8) is extended vertically and downwards, wherein the extension member (8) is collapsible in nature and advantageously offers being adjusted at different heights as chosen and selected exclusively by the user. Line (11) schematically indicates where the first telescopic portion of the extension member (8) ends with the second telescopic portion of the extension member (8) passing inside of the first telescopic portion.

The telescopic extension member (8) is further operatively connected with and is in direct contact with a lower second handle (10), which is suited and meant to be held by the child. As such, the extension member (8) is an extension of the pole (4), and the extension member (8) passes through the first upper grasping handle (6). Thanks to this feature, as the extension member (8) is vertically collapsible and adjustable, it thereby affords the advantage to allow the lower second handle (10) to be placed adjacent the first upper user grasping handle (6) when desired by the adult user and at will. This of course, in return, provides the effect of altering the height of the umbrella (1), such that it can easily assume a minimum and a maximum height fully controlled by the adult user. Without being limited by theory, in other words, the height of the umbrella (1) can be easily adjusted by the telescopic extension member (8), such that the lower second handle (10) becomes extendable in order for the umbrella (1) to be held comfortably by a child having substantially any height. In accordance with this embodiment, this is preferably achieved by the child holding the lower second handle (10) on one side, and the adult holding the first upper user grasping handle (6) on the other side, thereby advantageously balancing out each other.

The second handle (10) further has built therein a button (10*a*) to operate the telescopic extension member. When button (10*a*) is engaged, the extension member (8) is dropped to the lower position for grasping of the handle by the child. Thus, button (10*a*) on the second handles acts as a release. Preferably, button (10*a*) can be configured to release the second handle 10) from the first user grasping handle (6), to change the adjustable height of the second handle by having a plurality of locking positions so that different heights can be selected each time the extension member (8) clicks into place, and ultimately, to release the second handle (10) when extended, so that it can retract and be accommodated inside the pole with the second handle (10) located adjacent to or attached to the first handle (6). In many ways, button (10*a*) operates similar to button (6*a*) which is conventional on many umbrellas as a catch/release mechanism for deploying and retracting the canopy (1).

These features are illustrated in more detail in FIGS. 1A and 1B, where the same numerals are used to designate the same component parts. In FIG. 1A, it can be seen that the extension member (8) is found at a maximum extendable conformation (8*a*). FIG. 1B, on the other hand, demonstrates the extension member (8) having a shorter height (8*b*), basically having undergone a vertical shortening, such that the distance between the first upper user grasping handle (6) and the second lower handle (10) has now become substantially minimized as compared to in FIG. 1A. In a preferred arrangement, the pole and extension member are configured and dimensioned such that, when the umbrella is not employed, the extension member is received within the pole with the handles adjacent each other for compact storage.

When the pole and extension member are each cylindrical, one may be configured to be of a larger diameter than the other so that they can be joined together. Typically, the extension member will have a smaller diameter so that it can telescopically fit within the pole for retraction therein when the umbrella is not deployed. Alternatively, the upper end of the extension member can be configured to be securely received within the user grasping handle. This can be accomplished by a screw thread or press fitting connection or by using a suitable adhesive to join those parts together. The extension member can then be configured to have a length that is telescopically adjustable and that when collapsed fits within the second handle for compact storage when the umbrella is not deployed.

FIGS. 1A and 1B also indicate another feature of the invention, which is a wrist or loop band (13) that can be provided on the first (6) or second (10) handle, respectively. This band (13) can facilitate carrying of the umbrella (1) when it is not deployed. The band (13) is shown attached to the first handle (6) in FIG. 1A. When it is attached to the second handle (10), as shown in FIG. 1B, however, it can be used to wrap around the child's hand to keep the child near the adult. Additionally, the band (13*a*) shown in FIG. 1B may be adjustable to conform to the child's hand. This can help prevent the child from running away from the adult or possibly from falling when walking together.

Figure 2:
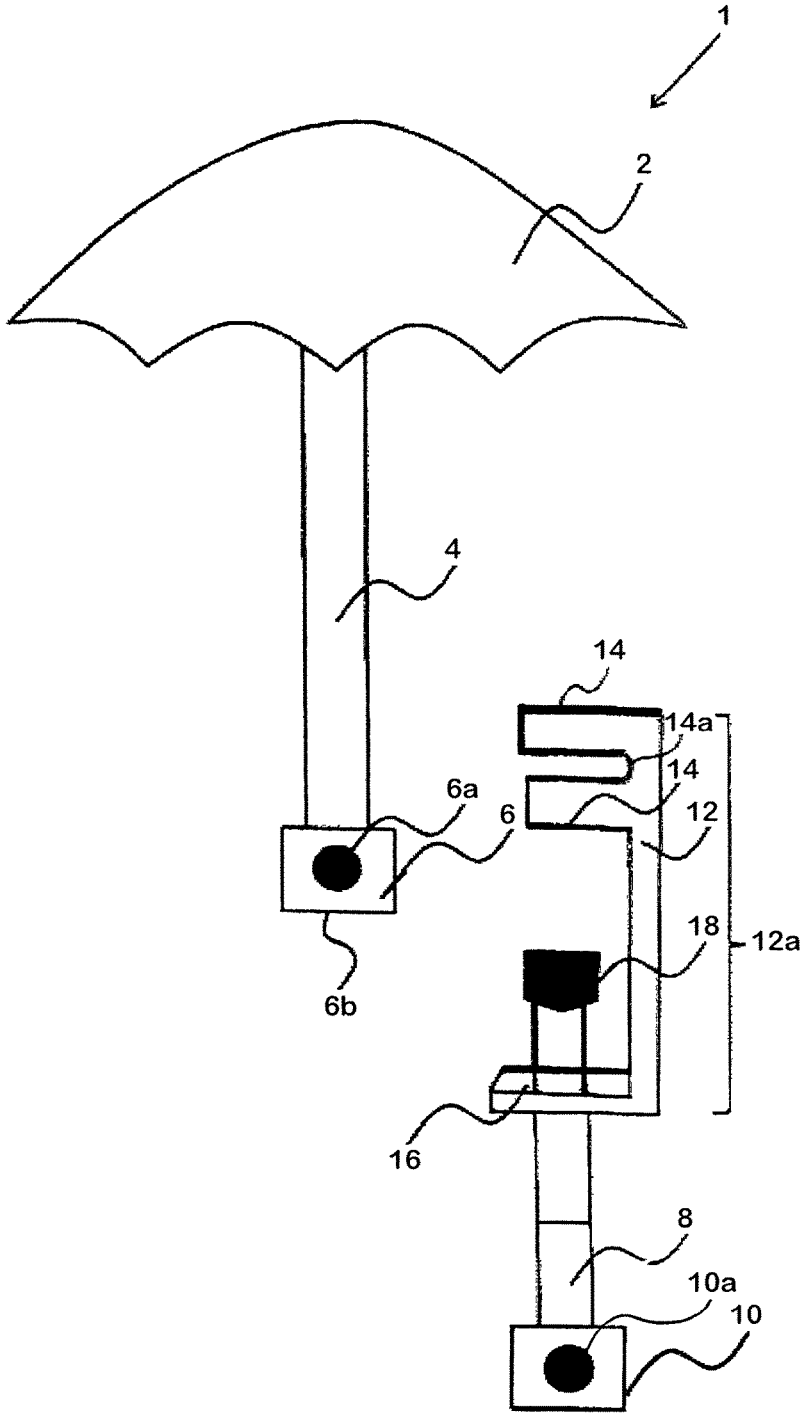
FIGS. 2 and 3 are schematic side views of the attachable dual handle umbrella in accordance with an embodiment of the invention.
Figure 3:
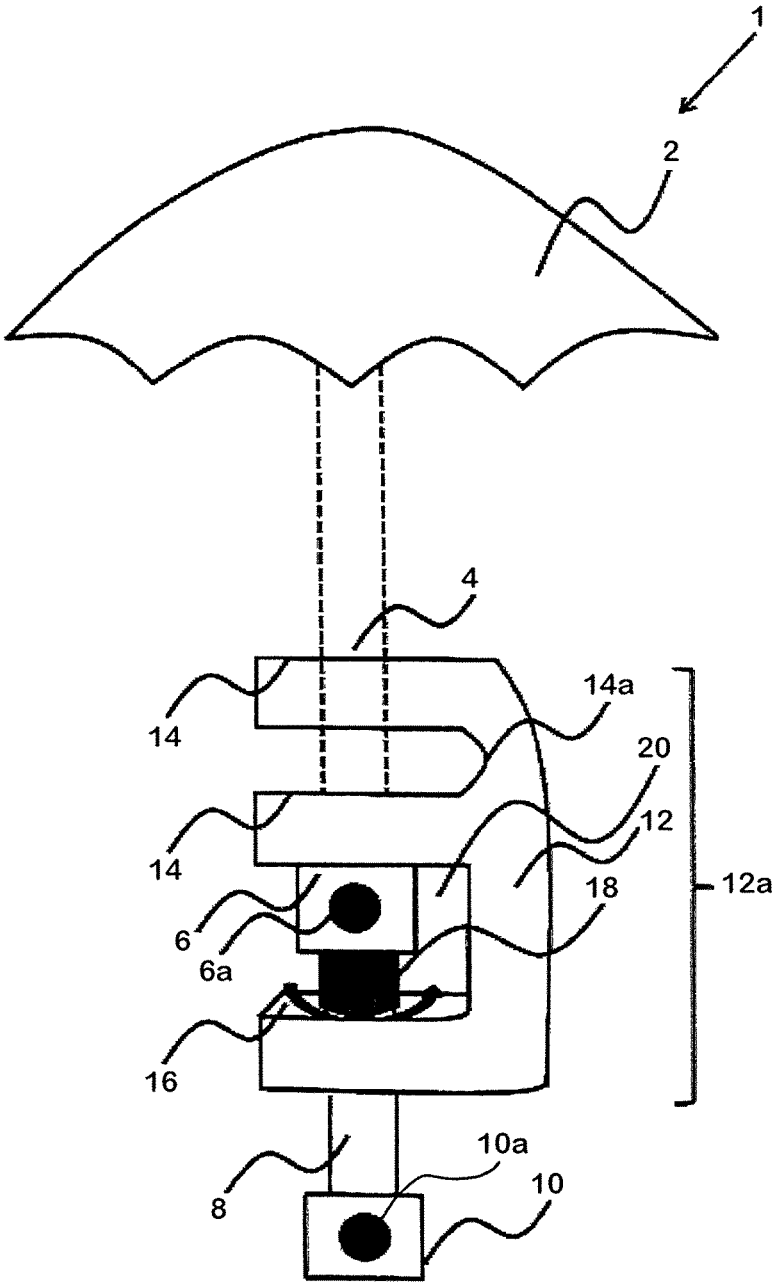

In accordance with yet another embodiment of the present invention, FIG. 2 depicts the individual components of the attachable dual handle umbrella (1), while FIG. 3 demonstrates the attached conformation of the dual handle umbrella (1).

First, referring to FIG. 2, the individual components of the attachable dual handle umbrella (1) includes an existing umbrella, and as previously explained, also in this embodiment, the dual handle umbrella (1) is characterized by comprising a canopy (2) attached to the upper part of the umbrella pole (4). The pole (4) is operatively connected directly with the first upper user grasping handle (6) for holding the umbrella (1) upright when the umbrella (1) is in use. The first upper user grasping handle (6) further has built therein a button (6*a*) to operate the umbrella (1). In this embodiment, the dual handle umbrella (1) is assembled and attached via connecting the first upper user grasping handle (6) situated on the umbrella with a connection member (12) which is lying on the exact opposite end of the lower second handle (10).

As can be depicted in FIG. 2, the connection member (12) can be thought as functioning as a securing adaptor structure, wherein the connection member (12) has the configuration of a clamping structure (12*a*) that has upper arms (14) and a lower plate (16) for easily receiving the first upper user grasping handle (6) of the umbrella (1) therebetween. The upper arms (14) may preferably assume an arcuate shape (14*a*), such that the upper arms (14) can easily conform to and grab the umbrella pole (4) thereby efficiently exhibiting a stable clamping effect. Further extending in a vertical direction downwards from the connection member (12) is the previously mentioned extension member (8). However, in this embodiment of the invention, the extension member (8) is attached to and is in an operative communication with a contact member (18) situated on the farthest top portion of the extension member (8) situated directly opposite the end of the lower second handle (10) to thereby serve a role as advantageously contacting a bottom portion (6*b*) of the first upper user grasping handle (6). As will be readily appreciated by one of ordinary skill in the art, the contact member (18) is movable towards or away from the first upper user grasping handle (6) afforded by the rotation of the connection member (12). As such, also in this embodiment of the present invention, there is provided a substantial flexibility of the height of the umbrella (1), which can be adjusted by the telescopic extension member (8) as already explained earlier which is illustrated in FIGS. 1A and 1B.

Now, generally referring to FIGS. 2 and 3, it will be described in greater detail how the connection member (12) can be attached to the umbrella (1) in practice. This is in general afforded thanks to a twisting and rotation mechanism. In essence, one first has to hold the umbrella (1) by the pole (4) and subsequently lead the pole (4) in between and through the opening of the upper arms (14) of the connection member (12) and until the bottom portion (6*b*) of the first grasping handle (6) makes a physical contact, and is operatively received by the contact member (18). When this has been executed, thereafter, one twists and turns the connection member (12) rotationally and counter-clockwise, while the first grasping handle (6) still maintains the physical contact with the contact member (18), so as to thereby fasten, secure and stabilize the umbrella (1) on the connection member (12).

In this embodiment, a counter-clockwise rotation is described and shown in FIG. 3. However in other embodiments, one of ordinary skill in the art will realize that the twisting may equally well be undertaken by turning it clock-wise, just as long as efficient tightening is provided. This is generally accomplished by using fastening mechanisms and materials taking advantage of for example e.g., pairing internal and external mating threads. This is made possible thanks to the extension member (8) also being attached to the lower plate (16) via mating threads, which altogether facilitates the flexibility and upwards or downwards movement of the contact member (18) via rotation. However, it is worth noting that one having skill in the art will readily realize that any such method that results in the formation of a stably attached umbrella (1) is in reality likewise applicable in this regard.

As depicted in FIG. 3, enough space and room (20) is still provided in the attached umbrella (1), and as such, attaching the first grasping handle (6) onto the contact member (18) does not compromise and block the room (20), whereby fingers of the adult are still able to curl around and hold the first grasping handle (6). By the same token, as explained previously, the child is then able to grab and hold the lower second handle (10) easily.

Thus, an improved dual handle umbrella (1) is thereby provided. The umbrella (1) further allows for the simultaneous holding and coordination of the umbrella (1) by the parent and the child by physically engaging the two distanced grasping handles (6) and (10) each with one of their hands, while the parent can hold the child with his or her second free hand.

Unless defined otherwise, all technical and scientific terms used herein have the same meaning as commonly understood by one of ordinary skill in the art to which this invention belongs. All technical and scientific terms used herein have the same meaning. Although any materials similar or equivalent to those described herein can also be used in the practice of the present invention, exemplary materials are described for illustrative purposes.

Unless defined otherwise, all technical and scientific terms used herein this disclosure have same meaning as commonly understood by one of ordinary skill in the art to which this invention belongs. As used herein and in the appended claims, the singular form "a," "and," "the" include plural referents unless the context clearly dictates otherwise. All technical and scientific terms used herein have the same meaning.

Thus for example any sequence(s) and/or temporal order of sequence of the different parts of the dual handle umbrella or connections or operations that are described herein are illustrative and should not be interpreted as being restrictive. Accordingly, it should be understood that operations may be shown and described as being in a sequence or temporal order, but they are not necessary limited to being carried out in any particular sequence or order.

The terms "comprises," "comprising," "includes," "including," "having" and their conjugates mean "including but not limited to." Terms and phrases used in this application, and variations thereof, unless otherwise expressly stated, should be construed as open ended as opposed to limiting. As examples of the foregoing, the term "including" should be read as meaning "including, without limitation" or the like. The term "example" is used to provide exemplary instances of the item in discussion, not an exhaustive or limiting list thereof. Adjectives such as e.g., "conventional," "traditional," "known" and terms of similar meaning should not be construed as limiting the item described to a given time period, or to an item available as of a given time. But instead these terms should be read to encompass conventional, traditional, normal, or standard technologies that may be available, known now, or at any time in the future. Likewise, a group of items linked with the conjunction "and" should not be read as requiring that each and every one of those items be present in the grouping, but rather should be read as "and/or" unless expressly stated otherwise. Similarly, a group of items linked with the conjunction "or" should not be read as requiring mutual exclusivity among that group, but rather should also be read as "and/or" unless expressly stated otherwise. The presence of broadening words and phrases such as "one or more," "at least," "but not limited to," or other like phrases in some instances shall not be read to mean that the narrower case is intended or required in instances, wherein such broadening phrases may be absent.

It should also be understood that the individual components of the dual handle umbrella in the Figures may not necessarily have been drawn to a correct scale. As such, due to the reason that the Figures are only for illustrative purposes, the comparable sizes of the individual components of the dual handle umbrella should not be limited and construed to be exactly what is viewed in the Figures.

It will be readily understood by one of ordinary skill in the relevant art that the present invention has broad utility and application. Although the present invention has been described and illustrated herein with referred to preferred embodiments, it will be apparent to those of ordinary skill in the art that other embodiments may perform similar functions and/or achieve like results. Thus, it should be understood that various features and aspects of the disclosed of the disclosed embodiments can be combined with, or substituted for one another in order to form varying modes of the disclosed invention. Many different embodiments such as variations, adaptations, modifications, and equivalent arrangements are will be implicitly and explicitly disclosed by the embodiments described herein, and thus fall within the scope and spirit of the present invention.

Thus, the scope of the embodiments of the present invention should be determined by the appended claims and their legal equivalents rather than by the Examples and Figures.

What is claimed is:

1. In an umbrella that includes a pole operatively associated with a user grasping handle for holding the umbrella upright when open for use, the improvement comprising a removably attached second handle spaced by a distance away from and below the user grasping handle, and an extension member operably associated with a connection member for removably connecting the second handle to the pole, wherein the connection member includes a clamping structure that has upper arms and a lower plate for receiving the user grasping handle therebetween, and wherein the extension member is adjustable to place the second handle at different distances away from the user grasping handle so that when the user grasps the grasping handle to hold the umbrella upright, a person who is shorter than the user can also hold onto the umbrella by grasping the second handle.

2. The umbrella of claim 1, wherein the extension member is collapsible to allow the second handle to be placed adjacent the user grasping handle.

3. The umbrella of claim 1, wherein the pole and extension member are configured and dimensioned such that, when the umbrella is not employed, the extension member is received within the pole or the second handle with the user and second handles adjacent each other for compact storage.

4. The umbrella of claim 1, wherein the extension member and lower plate are threadedly engaged to facilitate upward or downward movement of the contact member toward or away from the first upper user grasping handle.

5. The umbrella of claim 1, further comprising a band on the first or second handle to facilitate carrying of the umbrella when not deployed.

6. The umbrella of claim 5 wherein the band is attached to the second handle and is adjustable for wrapping around the shorter person's hand.

7. The umbrella of claim 1, which includes a canopy that is sufficiently large to shield the user and shorter person from rainfall.

8. In an umbrella that includes a pole operatively associated with a user grasping handle for holding the umbrella upright when open for use, the improvement comprising a removably attached second handle spaced by a distance away from and below the user grasping handle by an extension member which is connected to the pole with a connection member including a clamping structure that has upper arms and a lower plate for receiving the user grasping handle therebetween, wherein the extension member is adjustable to place the second handle at different distances away from the user grasping handle so that when the user grasps the grasping handle to hold the umbrella upright, a person who is shorter than the user can also hold onto the umbrella by grasping the second handle, wherein the extension member includes a contact member on a surface opposite the second lower handle for contacting a bottom portion of the user grasping handle, wherein the contact member is movable towards or away from the user grasping handle by rotation of the connection member.

9. The umbrella of claim 8, wherein the extension member is collapsible to allow the second handle to be placed adjacent the user grasping handle.

10. The umbrella of claim 8, wherein the pole and extension member are configured and dimensioned such that, when the umbrella is not employed, the extension member is received within the pole or the second handle with the user and second handles adjacent each other for compact storage.

11. The umbrella of claim 8, further comprising a band on the first or second handle to facilitate carrying of the umbrella when not deployed.

12. The umbrella of claim 11, wherein the band is attached to the second handle and is adjustable for wrapping around the shorter person's hand.

13. The umbrella of claim 8, which includes a canopy that is sufficiently large to shield the user and shorter person from rainfall.

* * * * *